US010344981B2

(12) United States Patent
Prociw et al.

(10) Patent No.: US 10,344,981 B2
(45) Date of Patent: Jul. 9, 2019

(54) STAGED DUAL FUEL RADIAL NOZZLE WITH RADIAL LIQUID FUEL DISTRIBUTOR

(71) Applicant: Delavan Inc, West Des Moines, IA (US)

(72) Inventors: Lev Alexander Prociw, Johnston, IA (US); Jason A. Ryon, Carlisle, IA (US)

(73) Assignee: Delavan Inc., West Des Moines, IA (US)

( * ) Notice: Subject to any disclaimer, the term of this patent is extended or adjusted under 35 U.S.C. 154(b) by 374 days.

(21) Appl. No.: 15/382,112

(22) Filed: Dec. 16, 2016

(65) Prior Publication Data

US 2018/0172275 A1 Jun. 21, 2018

(51) Int. Cl.

| | |
|---|---|
| ***F23R 3/10*** | (2006.01) |
| ***F23R 3/14*** | (2006.01) |
| ***F23R 3/28*** | (2006.01) |
| ***F23R 3/36*** | (2006.01) |

(Continued)

(52) U.S. Cl.

CPC ..... *F23R 3/286* (2013.01); *F23D 11/10* (2013.01); *F23D 11/38* (2013.01); *F23D 14/24* (2013.01);

(Continued)

(58) Field of Classification Search

CPC .. F23R 3/14; F23R 3/283; F23R 3/286; F23R 3/346; F23R 3/36; F23R 3/10; F23R 3/12; F23R 3/28; F23D 11/107; F23D 11/383; F23D 17/002; F23D 11/104; F23D 14/24; F23D 2204/10; F23C 7/004; F23C 2201/30; F23C 2201/301; F23C 7/002; F02C 7/2365; F02C 7/222

See application file for complete search history.

(56) References Cited

U.S. PATENT DOCUMENTS 3,937,011 A * 2/1976 Caruel ..... F23D 11/107 60/737

4,842,197 A * 6/1989 Simon ..... F23C 7/002 239/400

(Continued)

OTHER PUBLICATIONS

Extended European Search Report dated Sep. 28, 2018, issued during the prosecution of corresponding European Patent Application No. EP 17206885.0 (7 pages).

*Primary Examiner* — Scott J Walthour
*Assistant Examiner* — Todd N Jordan
(74) *Attorney, Agent, or Firm* — Lock Lord LLP; Scott D. Wofsy; Joshua L. Jones

(57) ABSTRACT

A nozzle includes a nozzle body defining a longitudinal axis and including a primary distributor and a secondary distributor. The primary distributor has an inner air passage fed by a radial swirler; a first fuel circuit radially outboard from the inner air passage with respect to the longitudinal axis; a second fuel circuit radially outboard from the first fuel circuit with respect to the longitudinal axis, wherein each of the first fuel circuit and the second fuel circuit extends from a respective fuel circuit inlet to a respective annular fuel circuit outlet; and an outer air passage defined between a fuel circuit outer wall and an outer air passage wall, wherein the outer air passage is a converging non-swirling outer air passage. The secondary distributor similar to the primary distributor is downstream of the primary distributor with respect to the longitudinal axis.

18 Claims, 4 Drawing Sheets

(51) Int. Cl.

| | |
|---|---|
| ***F23D 11/38*** | (2006.01) |
| ***F23D 14/24*** | (2006.01) |
| ***F23R 3/34*** | (2006.01) |
| ***F23R 3/54*** | (2006.01) |
| ***F23D 11/10*** | (2006.01) |

(52) U.S. Cl.
CPC ..... *F23R 3/10* (2013.01); *F23R 3/14* (2013.01); *F23R 3/346* (2013.01); *F23R 3/36* (2013.01); *F23R 3/54* (2013.01); *F23D 11/105* (2013.01); *F23D 11/383* (2013.01); *F23D 2900/11101* (2013.01)

(56) References Cited

U.S. PATENT DOCUMENTS

| | | | | |
|---|---|---|---|---|
| 5,197,289 | A * | 3/1993 | Glevicky | F23R 3/04 60/746 |
| 5,505,045 | A * | 4/1996 | Lee | F23D 11/107 239/424 |
| 6,272,840 | B1 * | 8/2001 | Crocker | F02C 7/22 239/404 |
| 7,454,914 | B2 * | 11/2008 | Prociw | F23D 11/105 29/889.2 |
| 8,312,724 | B2 | 11/2012 | Dai et al. | |
| 9,033,263 | B2 | 5/2015 | Rackwitz | |
| 9,188,063 | B2 * | 11/2015 | Prociw | F23R 3/28 |
| 9,441,836 | B2 | 9/2016 | Cohen et al. | |
| 2005/0223710 | A1 * | 10/2005 | Creighton | F23R 3/14 60/740 |
| 2011/0089262 | A1 | 4/2011 | Thomson et al. | |
| 2014/0338342 | A1 * | 11/2014 | Graham | F23R 3/28 60/740 |
| 2016/0290291 | A1 * | 10/2016 | Prociw | F02C 7/22 |
| 2016/0290649 | A1 * | 10/2016 | Prociw | F23R 3/286 |
| 2017/0108223 | A1 * | 4/2017 | Ryon | F23R 3/12 |
| 2018/0172272 | A1 * | 6/2018 | Prociw | F02C 7/22 |
| 2018/0172274 | A1 * | 6/2018 | Prociw | F23R 3/14 |

* cited by examiner

STAGED DUAL FUEL RADIAL NOZZLE WITH RADIAL LIQUID FUEL DISTRIBUTOR

BACKGROUND OF THE INVENTION

1. Field of the Invention

The present disclosure relates to nozzles, and more particularly to nozzles for multiple fuels such as used in industrial gas turbine engines.

2. Description of Related Art

Dual fuel capability does not easily lend itself to low emissions. In conventional dual fuel nozzles, e.g., for industrial gas turbine engines, liquid fuel is usually injected from a pressure atomizer located along the center line of a nozzle. It is difficult in conventional nozzles to get the liquid fuel to the outer reaches of the fuel nozzle, especially in large diameter nozzles.

The conventional techniques have been considered satisfactory for their intended purpose. However, there is an ever present need for improved dual fuel nozzles. This disclosure provides a solution for this problem.

SUMMARY OF THE INVENTION

A nozzle includes a nozzle body defining a longitudinal axis and including a primary distributor and a secondary distributor. The primary distributor has an inner air passage fed by a radial swirler; a first fuel circuit radially outboard from the inner air passage with respect to the longitudinal axis; a second fuel circuit radially outboard from the first fuel circuit with respect to the longitudinal axis, wherein each of the first fuel circuit and the second fuel circuit extends from a respective fuel circuit inlet to a respective annular fuel circuit outlet; and an outer air passage defined between a fuel circuit outer wall and an outer air passage wall, wherein the outer air passage is a converging non-swirling outer air passage.

The secondary distributor is downstream, e.g., immediately downstream, of the primary distributor with respect to the longitudinal axis. The secondary distributor has a radial swirler feeding into the inner air passage; a first fuel circuit radially outboard from the inner air passage with respect to the longitudinal axis; a second fuel circuit radially outboard from the first fuel circuit with respect to the longitudinal axis, wherein each of the first fuel circuit and the second fuel circuit extends from a respective fuel circuit inlet to a respective annular fuel circuit outlet; and an outer air passage defined between a fuel circuit outer wall and an outer air passage wall, wherein the outer air passage is a converging non-swirling outer air passage.

The primary and secondary distributors can be separated from one another by a spacer. At least one of the first and second fuel circuits of the primary and secondary distributors can include a plurality of helical passages, wherein each helical passage opens tangentially with respect to the respective fuel circuit outlet. The helical passages can define a flow exit angle relative to the longitudinal axis of at least 85°.

For at least one of the primary and secondary distributors, the second fuel circuit can be defined between a fuel circuit outer wall and an intermediate fuel circuit wall, and wherein the first fuel circuit can be defined between a fuel circuit inner wall and the intermediate fuel circuit wall, wherein the intermediate fuel circuit wall is radially outboard from the inner fuel circuit wall with respect to the longitudinal axis, and wherein the outer fuel circuit wall is radially outboard of the intermediate fuel circuit wall with respect to the longitudinal axis. For the at least one of the primary and secondary distributors, the respective annular fuel circuit outlets of the first and second fuel circuits can be separated from one another only by the intermediate fuel circuit wall. For the at least one of the primary and secondary distributors, at least a portion of each of the fuel circuit inner, outer, and intermediate walls can have a conical shape that converges toward the longitudinal axis.

For at least one of the primary and secondary distributors, the fuel circuit inlet of the first fuel circuit can include a plurality of circumferentially spaced apart openings for fluid communication with a fuel manifold, wherein the fuel circuit inlet of the second fuel circuit includes a plurality of circumferentially spaced apart openings for fluid communication with the fuel manifold. For the at least one of the primary and secondary distributors, the radial swirler can include radial swirl vanes circumferentially spaced apart from one another about an annular inner air inlet, wherein the nozzle body includes a plurality of tubes, each connecting the circumferentially spaced apart openings wherein the tubes for both the first and second fuel circuits pass axially through the radial swirl vanes. For the at least one of the primary and secondary distributors, a first set of the tubes can connect the circumferentially spaced apart openings of the second fuel circuit and can pass axially through the first fuel circuit. A second set of the tubes can connect the circumferentially spaced apart openings of the first fuel circuit and can pass axially through respective vanes of the radial swirler. The first and second sets of the tubes can pass through the radial swirlers of both the primary and secondary distributors. Each tube in the first set of tubes can pass through a respective one of the tubes in the second set of tubes.

For each of the first and second distributors, the inner air passage, outer air passage, first fuel circuit, and second fuel circuit are configured for diffusion flame injection without pre-mixing within the nozzle body. The inner air passage can be free from obstructions along the longitudinal axis downstream of the radial swirler. For each of the primary and secondary distributors, the second fuel circuit can be configured for injection of liquid fuel and the first fuel circuit can be configured for injection of gaseous fuel. An ignitor can be included concentrically and coaxially with the nozzle body in an upstream wall of the nozzle body.

In another aspect, a nozzle a nozzle body defining a longitudinal axis and including a primary distributor a secondary distributor downstream of the primary distributor with respect to the longitudinal axis. Each of the primary and secondary distributors includes first and second airflow passages and first and second fuel flow circuits, both of the airflow passages and both of the fuel flow circuits being defined at least in part between pairs of frustoconical walls, the airflow passages and fuel flow circuits being positioned in order of upstream to downstream, as determined by fluid flowing axially through the nozzle, in the order of first airflow passage, first fuel flow circuit, second fuel flow circuit, and second airflow passage, the first airflow passage being fed air through first swirling vanes configured to swirl air flowing therethrough, and the second airflow passage being fed air through second vanes not configured to swirl air flowing therethrough.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
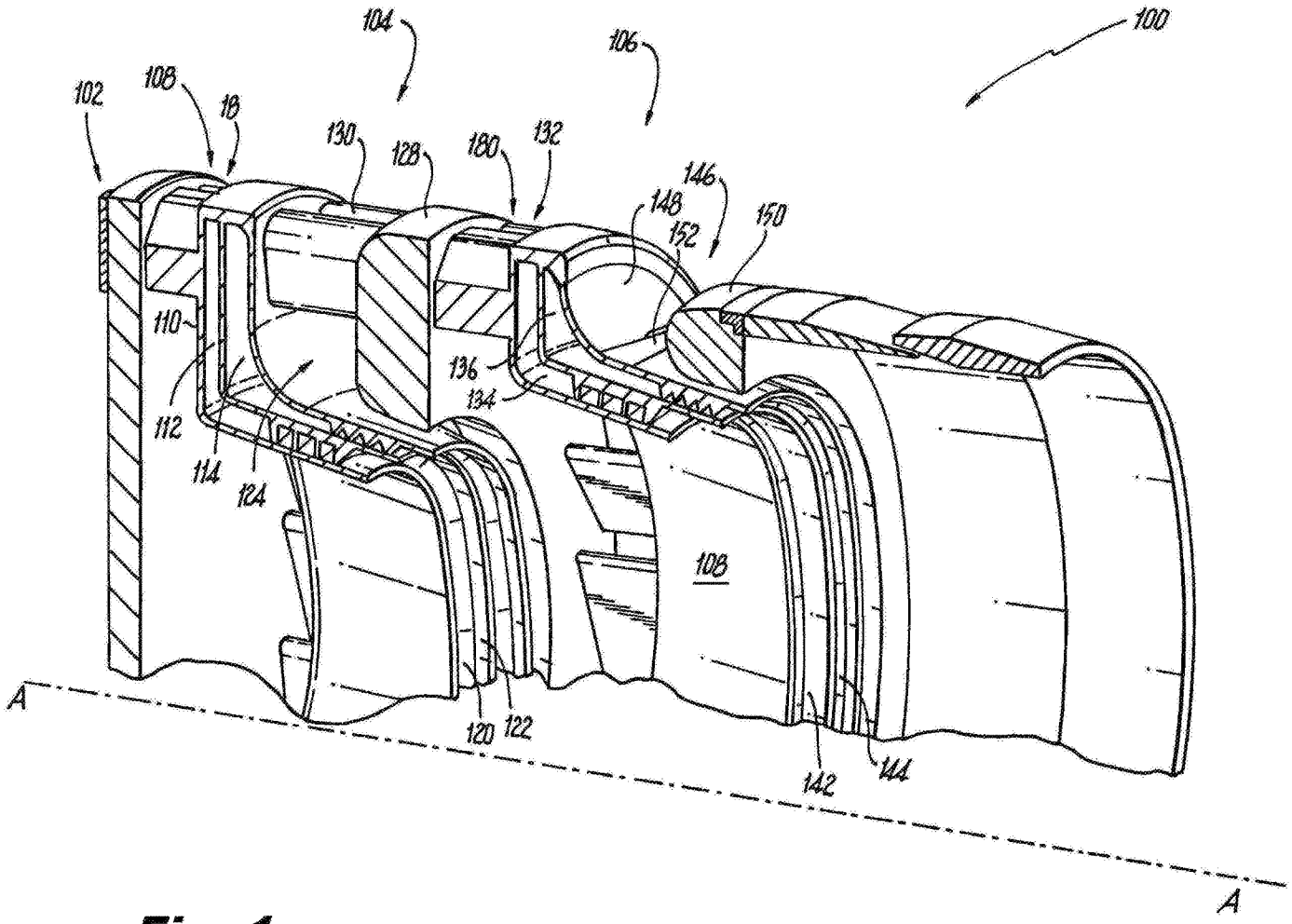
FIG. 1 is a cross-sectional perspective view of a portion of an exemplary embodiment of a nozzle constructed in accordance with the present disclosure, showing the radial swirler vanes for the inner air passage and the non-swirling standoffs for the outer air passage.

Reference will now be made to the drawings wherein like reference numerals identify similar structural features or aspects of the subject disclosure. For purposes of explanation and illustration, and not limitation, a partial view of an exemplary embodiment of a nozzle in accordance with the disclosure is shown in FIG. 1 and is designated generally by reference character 100. Other embodiments of nozzles in accordance with the disclosure, or aspects thereof, are provided in FIGS. 2-4, as will be described. The systems and methods described herein can be used to provide dual fuel combustion in gas turbine engines, where both fuels can be staged. So for example industrial gas turbine engines can use liquid and/or gaseous fuel and can switch between or apportion between liquid and gaseous fuels on demand. U.S. patent application Ser. No. 14/674,580 filed Mar. 31, 2015 is incorporated by reference herein in its entirety.

Nozzle 100 includes a nozzle body 102 defining a longitudinal axis A and including a primary distributor 104 and a secondary distributor 106. The primary distributor 104 has an inner air passage 108 fed by a radial swirler 110, e.g., a first of two air passages of the primary distributor 104 feeding into inner air passage 108. A first fuel circuit 112 is included radially outboard from the inner air passage 108 with respect to the longitudinal axis A. A second fuel circuit 114 is included radially outboard from the first fuel circuit 112 with respect to the longitudinal axis A. Each of the first and second fuel circuits 112 and 114 extends from a respective fuel circuit inlet 116 or 118 (shown in FIG. 3) to a respective annular fuel circuit outlet 120 and 122. Primary distributor 104 also includes an outer air passage 124, e.g., the second of two air passages of the primary distributor 104 feeding into inner air passage 108, defined between a fuel circuit outer wall 126 and an outer air passage wall 128, wherein the outer air passage 124 is a converging non-swirling outer air passage. Non-swirling, i.e. radially oriented, spacer vanes 130 connect between outer air passage wall 128 and the fuel circuit outer wall 126.

The secondary distributor 106 is downstream, e.g., immediately downstream, of the primary distributor 104 with respect to the longitudinal axis A. The secondary distributor 106 has a radial swirler 132 feeding into the inner air passage 108, e.g., a first of two air passages of the secondary distributor 106 feeding into inner air passage 108. A first fuel circuit 134 is included radially outboard from the inner air passage 108 with respect to the longitudinal axis A. A second fuel circuit 136 radially outboard from the first fuel circuit 134 with respect to the longitudinal axis A. Each of the first fuel circuit 134 and the second fuel circuit 136 extends from a respective fuel circuit inlet 138 or 140 (identified in FIG. 3) to a respective annular fuel circuit outlet 142 or 144. Secondary distributor 106 also includes an outer air passage 146, e.g., the second of two air passages of the secondary distributor 106 feeding into inner air passage 108, defined between a fuel circuit outer wall 148 and an outer air passage wall 150. The outer air passage 146 is a converging non-swirling outer air passage with non-angled (radially oriented) spacers 152 connecting between fuel circuit outer wall 148 and outer air passage wall 150 to provide space for the outer air passage 146.

Figure 2:
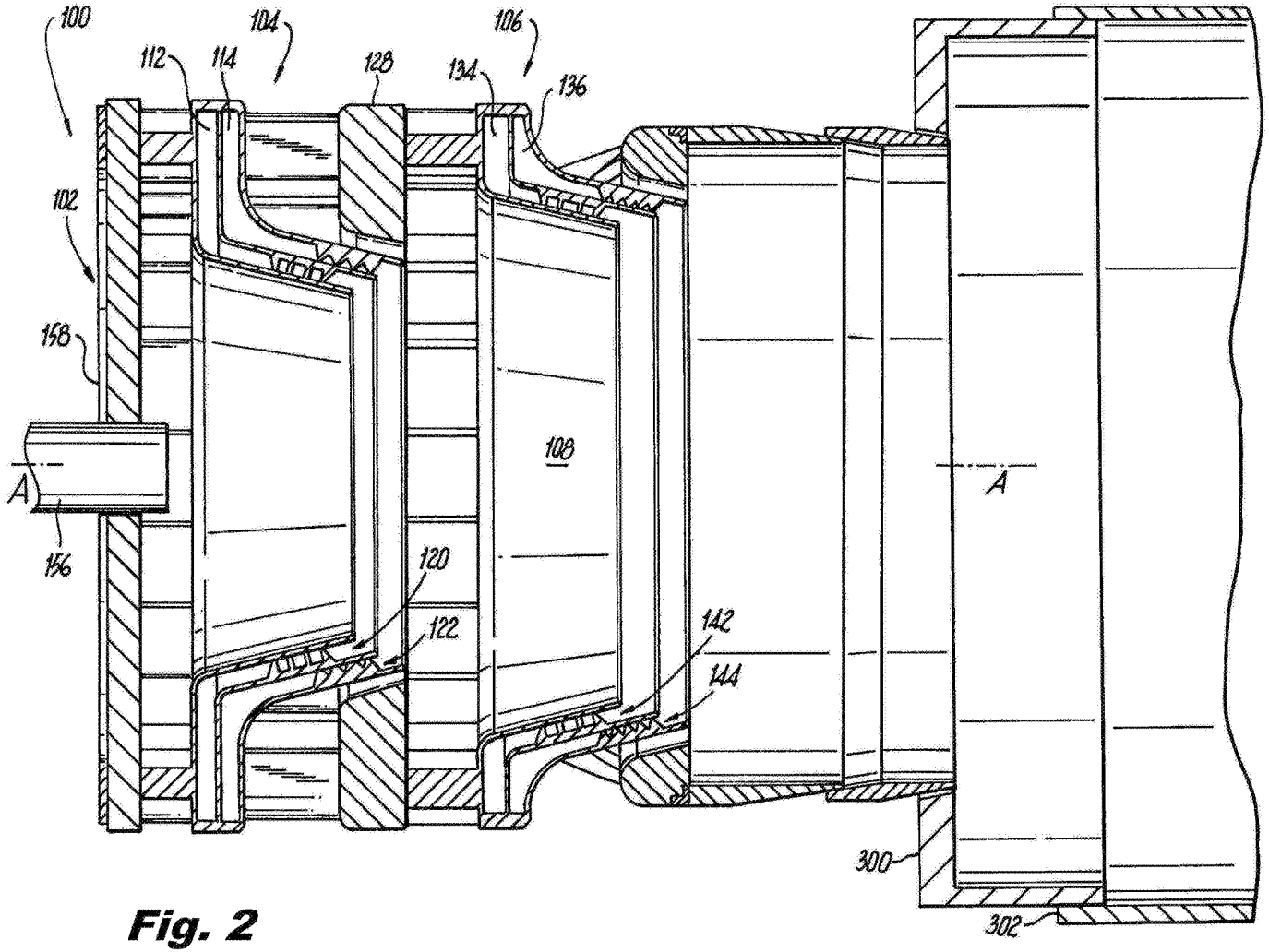
FIG. 2 is a side-elevation cross-sectional view of the nozzle of FIG. 1, showing the first and second fuel circuits of each of the two fuel distributors of the nozzle.

With reference now to FIG. 2, the primary and secondary distributors 104 and 106 are separated from one another by a spacer in the form of outer air passage wall 128. Each of the first and second fuel circuits 112, 114, 134, and 136 of the primary and secondary distributors 104 and 106 can include a plurality of helical passages 154, wherein each helical passage opens tangentially with respect to the respective fuel circuit outlet 120, 122, 142, and 144. The helical passages 154 can define a flow exit angle θ (identified in FIG. 1) relative to the longitudinal axis A of at least 85°. The inner air passage 108 can be free from obstructions, such as pilot fuel injectors or the like, along the longitudinal axis A downstream of the radial swirler 104.

Figure 3:
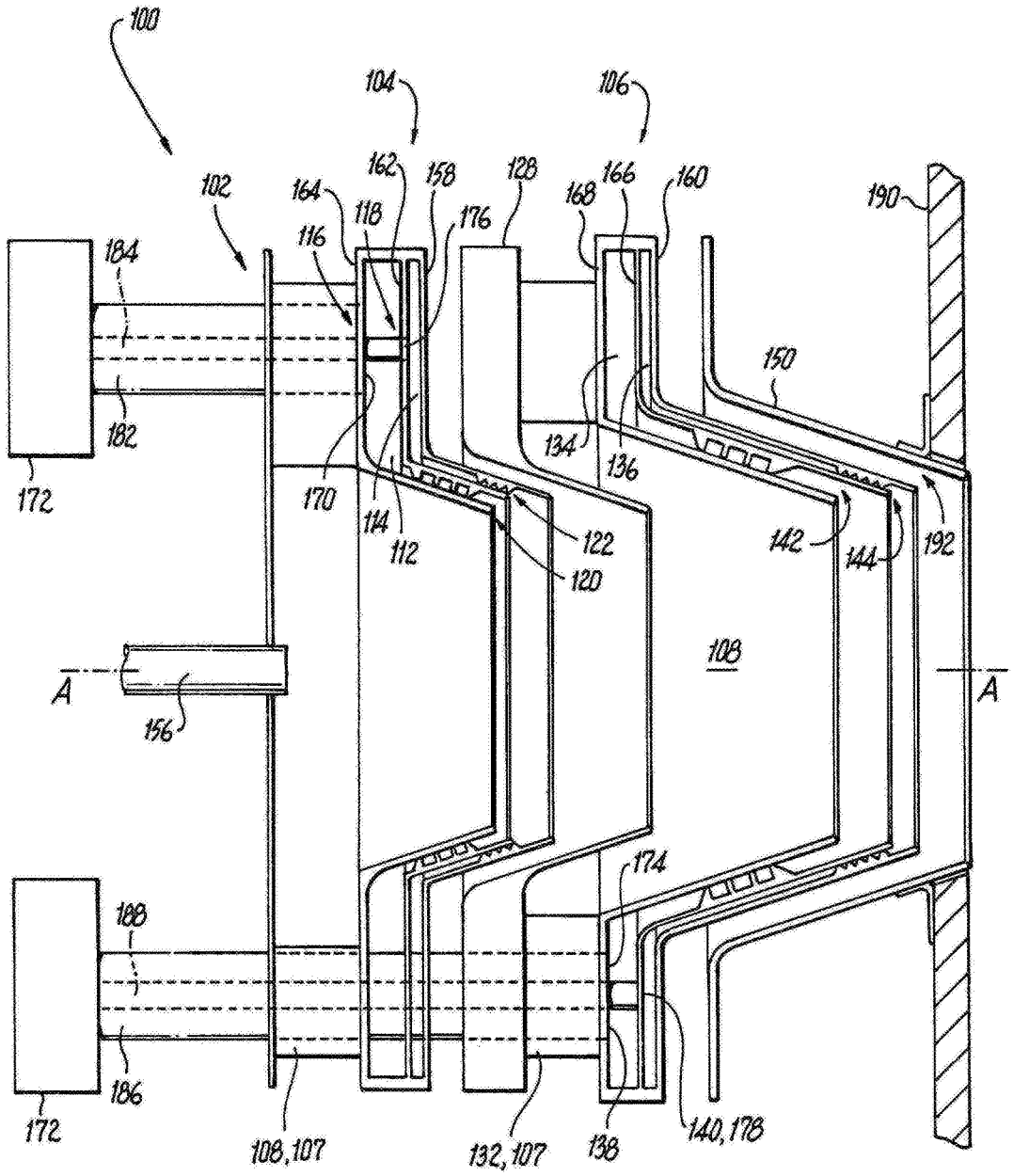
FIG. 3 is a schematic side-elevation cross-sectional view of the nozzle of FIG. 1, showing flow arrows to indicate flow through the air passages and fuel circuits.

With reference to FIG. 3, for each of the primary and secondary distributors 104 and 106, the respective second fuel circuit 114 and 136 is defined between a respective fuel circuit outer wall 158/160 and a respective intermediate fuel circuit wall 162/164. The first fuel circuits 112 and 134 are defined between a respective fuel circuit inner wall 166/168 and the respective intermediate fuel circuit wall 162/164. The intermediate fuel circuit walls 162/164 are radially outboard from the respective inner fuel circuit walls 164 and 166 with respect to the longitudinal axis A, and the outer fuel circuit walls 158 and 160 are radially outboard of the respective intermediate fuel circuit walls 162 and 166 with respect to the longitudinal axis A.

For each of the primary and secondary distributors 104 and 106, the respective annular fuel circuit outlets 120/122 and 142/144 of the first and second fuel circuits 112/114 and 134/163 are be separated from one another only by the respective intermediate fuel circuit wall 162 or 166. For both of the primary and secondary distributors 104 and 106, a downstream portion of each of the fuel circuit inner, outer, and intermediate walls 164, 168, 162, 166, 158, and 160 has a conical shape, e.g., frustoconical, that converges toward the longitudinal axis A. Same can be said for the intermediate wall 128 and outer air passage wall 150, each has a conical downstream portion that converges toward the longitudinal axis A.

For each of the primary and secondary distributors 104 and 106, the fuel circuit inlet 116 and 138 of the respective first fuel circuit 112 or 134 includes one or more circumferentially spaced apart openings 170 or 174 for fluid communication with a fuel manifold 172. The respective fuel circuit inlets 118 and 140 of the second fuel circuits 114 and 136 include one or more respective circumferentially spaced apart openings 176 or 178 for fluid communication with the fuel manifold 172.

In each of the primary and secondary distributors 104 and 106, the radial swirler 108 and 132 includes radial swirl vanes 107 circumferentially spaced apart from one another about an annular inner air inlet 180, wherein the nozzle body 102 includes a plurality of tubes 182, 184, 186, and 188, each connecting the respective circumferentially spaced apart openings 170, 176, 174, or 178 wherein the tubes 182, 184, 186, and 188 pass axially through the radial swirl vanes 107. For the each of the primary and secondary distributors 104 and 106, a first set of the tubes 184 and 188 can connect the circumferentially spaced apart openings 176 and 178, respectively, of the second fuel circuits 114 and 136 and pass axially through the respective first fuel circuits 112 and 134. Similarly, a second set of the tubes 182 and 186 respectively connect the circumferentially spaced apart openings 170 and 174 of the first fuel circuit and passes axially through respective vanes 107. The tubes 186 and 188 pass through the radial swirlers 108 and 132 of both the primary and secondary distributors 104 and 106. Each tube 184 and 188 passes through a respective one of the tubes 182 and 186.

Figure 4:
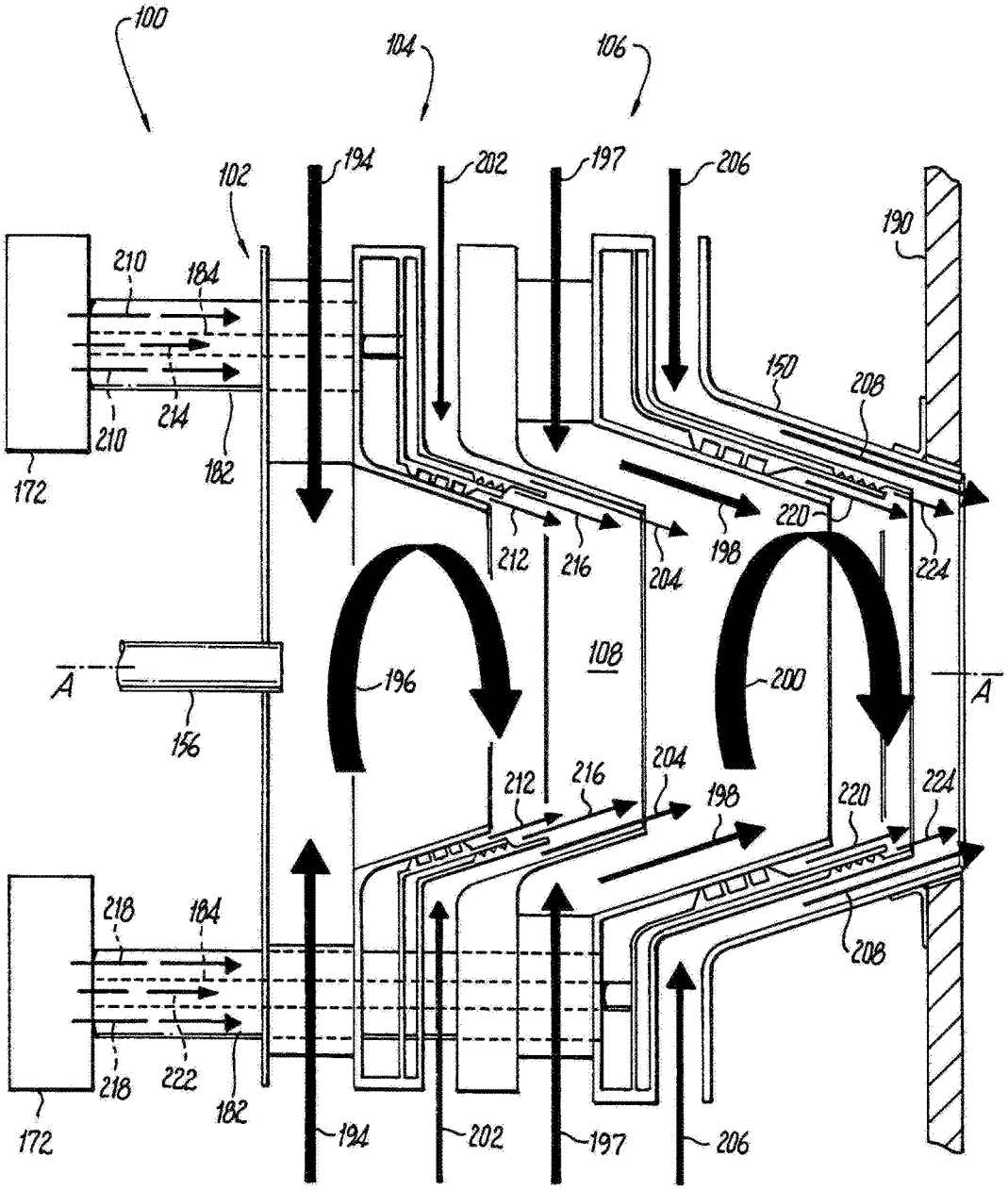
FIG. 4 is a schematic side-elevation cross-sectional view of the nozzle of FIG. 1, showing flow arrows to indicate flow through the air passages and fuel circuits.

Referring now to FIG. 4, arrows 194, 196, 198, and 200 indicate swirling air flow into and through inner air passage 108 from the first and second radial swirlers 110 and 132. Arrows 206 and 208 indicate non-swirling air flow through outer air passage 146 and arrows 202 and 204 indicate non-swirling air flow through outer air passage 124. Arrows 210 and 212 indicate fuel flow through the first fuel circuit 112 and arrows 214 and 216 indicate flow through the second flow circuit 114 of the primary distributor 104. Similarly, arrows 218 and 220 indicate fuel flow through the first fuel circuit 134 and arrows 222 and 224 indicate flow through the second flow circuit 136 of the secondary distributor 106. The outer air flow issued from outer air passage 124 and the outer air flow through outer air passage 146 converges and is not swirled. The inner air flow from inner air passage 108 diverges and is swirled. Air fuel mixing occurs downstream of the nozzle 100 in a non-premixed fashion. The mixing zone created by nozzle 100 permits rapid mixing of fuel and air downstream of nozzle 100.

For each of the first and second distributors 104 and 106, the inner air passage 104, outer air passage 124/146, first fuel circuit 112/134, and second fuel circuit 114/136 are configured for diffusion flame injection without pre-mixing. For each of the primary and secondary distributors 104 and 106, the second fuel circuit 114/136 can be configured for injection of liquid fuel and the first fuel circuit 112/134 can be configured for injection of gaseous fuel. Air fuel mixing continues to occur downstream of the nozzle 100 in a non-premixed fashion. The mixing zone created by nozzle 100 permits rapid mixing of fuel and air downstream of nozzle 100. Manifold 172 can therefore be a dual fuel manifold for supplying separate types of fuel, e.g., liquid and gaseous, to the separate fuel circuits 112, 114, 134, and 136. Manifold 172 can control the staging of fuel. For example, start up can be done with only one of the two stages issuing fuel from only one distributor 104 or 106, which can run rich, then later can run leaner and with both stages and/or both distributors 104 and 106 after startup. Between 40%-50% of the air through the nozzle enters through the radial swirlers 110 and 132.

Since the inlets of all the inner and outer air passages 108, 124, and 146 open toward the radial direction, all can utilize radial air feeds. This permits less pressure drop in turning the air flow into the nozzle 100, e.g. in a reverse flow combustor. Mixing level can be controlled by adjusting the diameter of the fuel distributors, e.g. the diameter of outlets 120, 122, 142 and 144, to suit the air flow required for a given mixing level.

Overall, the inner diameter of primary distributor 104 is smaller than that of secondary distributor 106 as shown in FIG. 2. This creates two annular mixing zones. Having two distributors increases the circumferential mixing length of the nozzle compared to conventional nozzles, so more of the combustor mixing work is performed by the nozzle 100, allowing the combustor 300 of a gas turbine engine to become a simple flow adapter to connect the nozzle to the turbine vanes 302, as indicated schematically in FIG. 2. An optional ignitor 156, as shown in FIG. 2, can be included, concentrically and coaxially with the nozzle body 102, in the upstream wall 158 of nozzle body 102 for start up.

The methods and systems of the present disclosure, as described above and shown in the drawings, provide for dual fuel injection with superior properties including diffusion flame injection with potentially large diameter injectors, and consistent flame regardless of how the two fuels are apportioned, with low emissions. Embodiments as disclosed herein can be used as retrofit nozzles to replace conventional nozzles in combustor domes. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A nozzle comprising:

a nozzle body defining a longitudinal axis and including:

a primary distributor having:

a first radial swirler, an inner air passage fed by the first radial swirler, a first fuel circuit radially outboard from the inner air passage with respect to the longitudinal axis, a second fuel circuit radially outboard from the first fuel circuit with respect to the longitudinal axis, wherein each of the first fuel circuit and the second fuel circuit extends from a respective fuel circuit inlet to a respective annular fuel circuit outlet, and a first outer air passage defined between a fuel circuit outer wall of the second fuel circuit and an outer air passage wall of the first outer air passage, wherein the first outer air passage is a converging non-swirling outer air passage; and a secondary distributor downstream of the primary distributor with respect to the longitudinal axis, the secondary distributor having:

a second radial swirler feeding into the inner air passage, a third fuel circuit radially outboard from the inner air passage with respect to the longitudinal axis, a fourth fuel circuit radially outboard from the third fuel circuit with respect to the longitudinal axis, wherein each of the third fuel circuit and the fourth fuel circuit extends from a respective fuel circuit inlet to a respective annular fuel circuit outlet, and a second outer air passage defined between a fuel circuit outer wall of the fourth fuel circuit and an outer air passage wall of the second outer air passage, wherein the second outer air passage is a converging non-swirling outer air passage.

2. The nozzle as recited in claim 1, wherein the primary and secondary distributors are separated from one another by a spacer.

3. The nozzle as recited in claim 1, wherein at least one of the first fuel circuit, the second fuel circuit, the third fuel circuit, or the fourth fuel circuit includes a plurality of helical passages, wherein each helical passage opens tangentially with respect to the respective annular fuel circuit outlet of the at least one of the first fuel circuit, the second fuel circuit, the third fuel circuit, or the fourth fuel circuit.

4. The nozzle as recited in claim 3, wherein the helical passages each define a flow exit angle relative to the longitudinal axis of at least 85°.

5. The nozzle as recited in claim 1, wherein, the second fuel circuit is defined between a fuel circuit outer wall of the second fuel circuit and a first intermediate fuel circuit wall, and wherein the first fuel circuit is defined between a fuel circuit inner wall of the first fuel circuit and the first intermediate fuel circuit wall, wherein the first intermediate fuel circuit wall is radially outboard from the inner fuel circuit wall of the first fuel circuit with respect to the longitudinal axis, and wherein the outer fuel circuit wall of the second fuel circuit is radially outboard of the first intermediate fuel circuit wall with respect to the longitudinal axis, and wherein the fourth fuel circuit is defined between a fuel circuit outer wall of the fourth fuel circuit and a second intermediate fuel circuit wall, and wherein the third fuel circuit is defined between a fuel circuit inner wall of the third fuel circuit and the second intermediate fuel circuit wall, wherein the second intermediate fuel circuit wall is radially outboard from the inner fuel circuit wall of the third fuel circuit with respect to the longitudinal axis, and wherein the outer fuel circuit wall of the fourth fuel circuit is radially outboard of the second intermediate fuel circuit wall with respect to the longitudinal axis.

6. The nozzle as recited in claim 5, wherein the respective annular fuel circuit outlets of the first and second fuel circuits are separated from one another only by the first intermediate fuel circuit wall, and the respective annular fuel circuit outlets of the third and fourth fuel circuits are separated from one another only by the second intermediate fuel circuit wall.

7. The nozzle as recited in claim 5, wherein at least a portion of each of the fuel circuit inner wall of the first fuel circuit, fuel circuit outer wall of the second fuel circuit, and first intermediate fuel circuit wall has a conical shape that converges toward the longitudinal axis, and wherein at least a portion of each of the fuel circuit inner wall of the third fuel circuit, fuel circuit outer wall of the fourth fuel circuit, and second intermediate fuel circuit wall has a conical shape that converges toward the longitudinal axis.

8. The nozzle as recited in claim 1, wherein the fuel circuit inlet of the first fuel circuit includes a plurality of circumferentially spaced apart openings for fluid communication with a fuel manifold, and wherein the fuel circuit inlet of the second fuel circuit includes a plurality of circumferentially spaced apart openings for fluid communication with the fuel manifold, and wherein the fuel circuit inlet of the third fuel circuit includes a plurality of circumferentially spaced apart openings for fluid communication with the fuel manifold, and wherein the fuel circuit inlet of the fourth fuel circuit includes a plurality of circumferentially spaced apart openings for fluid communication with the fuel manifold.

9. The nozzle as recited in claim 8, wherein, the first radial swirler includes first radial swirl vanes circumferentially spaced apart from one another about an annular inner air inlet, wherein the nozzle body includes a first plurality of tubes, each connecting the circumferentially spaced apart openings of the first fuel circuit and second fuel circuit with the fuel manifold wherein the tubes for both the first and second fuel circuits pass axially through the first radial swirl vanes, and wherein the second radial swirler includes second radial swirl vanes circumferentially spaced apart from one another about an annular inner air inlet, wherein the nozzle body includes a second Plurality of tubes, each connecting the circumferentially spaced apart openings of the third fuel circuit and fourth fuel circuit with the fuel manifold wherein the tubes for both the third and fourth fuel circuits pass axially through the second radial swirl vanes.

10. The nozzle as recited in claim 9, wherein a first set of the tubes of the first plurality connect the circumferentially spaced apart openings of the second fuel circuit and passes axially through the first fuel circuit, and wherein a third set of the tubes of the second plurality connect the circumferentially spaced apart openings of the fourth fuel circuit and passes axially through the third fuel circuit.

11. The nozzle as recited in claim 10, wherein a second set of the tubes of the first plurality connects the circumferentially spaced apart openings of the first fuel circuit and passes axially through respective first radial swirl vanes of the first radial swirler, and wherein a fourth set of the tubes of the second plurality connects the circumferentially spaced apart openings of the third fuel circuit and passes axially through respective second radial swirl vanes of the second radial swirler.

12. The nozzle recited in claim 11, wherein the third and fourth sets of the tubes pass through the first and second radial swirlers, respectively.

13. The nozzle as recited in claim 11, wherein each tube in the first set of tubes passes through a respective one of the tubes in the second set of tubes, and wherein each tube in the third set of tubes passes through a respective one of the tubes in the fourth set of tubes.

14. The nozzle as recited in claim 1, wherein the first and second distributors are configured for diffusion flame injection without pre-mixing within the nozzle body.

15. The nozzle as recited in claim 1, wherein the inner air passage is free from obstructions along the longitudinal axis downstream of the first radial swirler.

16. The nozzle as recited in claim 1, wherein the second and fourth fuel circuits are configured for injection of liquid fuel and the first and third fuel circuits are configured for injection of gaseous fuel.

17. The nozzle as recited in claim 1, wherein an ignitor is included concentrically and coaxially with the nozzle body in an upstream wall of the nozzle body.

18. A nozzle comprising:

a nozzle body defining a longitudinal axis and including:

a primary distributor including a first airflow passage, a second airflow passage, a first fuel flow circuit, and a second fuel flow circuit, each of the first airflow passage, the second airflow passage, the first fuel flow circuit, and the second fuel flow circuit being defined at least in part between respective pairs of frustoconical walls, the first and second airflow passages and the first and second fuel flow circuits being positioned in order of upstream to downstream, as determined by fluid flowing axially through the nozzle, in the order of the first airflow passage, the first fuel flow circuit, the second fuel flow circuit, and the second airflow passage, the first airflow passage including first radial swirling vanes and being fed air through the first radial swirling vanes, wherein the first radial swirling vanes are configured to swirl air flowing into the first airflow passage, and the second airflow passage including second vanes and being fed air through the second vanes, wherein the second vanes are not configured to swirl air flowing into the second airflow passage; and a secondary distributor downstream of the primary distributor with respect to the longitudinal axis, the secondary distributor including a third airflow passage, a fourth airflow passage, a third fuel flow circuit, and a fourth fuel flow circuit, each of the third airflow passage, the fourth airflow passage, the third fuel flow circuit and the fourth fuel flow circuit being defined at least in part between respective pairs of frustoconical walls, the third and fourth airflow passages and the third and fourth fuel flow circuits each being positioned in order of upstream to downstream, as determined by fluid flowing axially through the nozzle, in the order of the third airflow passage, the third fuel flow circuit, the fourth fuel flow circuit, and the fourth airflow passage, the third airflow passage including third radial swirling vanes and being fed air through the third radial swirling vanes, wherein the third radial swirling vanes are configured to swirl air flowing into the third airflow passage, and the fourth airflow passage including fourth vanes and being fed air through the fourth vanes, wherein the fourth vanes are not configured to swirl air flowing into the fourth airflow passage.

* * * * *